US005172832A

United States Patent [19]

Rodriquez, Jr. et al.

[11] Patent Number: 5,172,832

[45] Date of Patent: Dec. 22, 1992

[54] LIQUID DISPENSING APPARATUS FOR DISPENSING LIQUID FROM A CONTAINER

[75] Inventors: Ismael Rodriquez, Jr., West Chester; Daniel M. McShane, Philadelphia, both of Pa.

[73] Assignee: Sunroc Corporation, Glen Riddle, Pa.

[21] Appl. No.: 745,577

[22] Filed: Aug. 15, 1991

[51] Int. Cl.[5] ..... B67D 5/62

[52] U.S. Cl. ..... 222/146.1; 62/390; 62/397; 141/314; 222/146.5; 222/146.6; 222/183; 222/185

[58] Field of Search ..... 222/105, 146.1, 146.5, 222/146.6, 183, 185, 460; 62/389-391, 393, 394, 396, 397; 141/10, 18, 114, 313, 314

[56] References Cited

U.S. PATENT DOCUMENTS

| | | | |
|---|---|---|---|
| 2,767,960 | 10/1956 | Fast | 222/146.1 X |
| 2,784,879 | 3/1957 | Fischer | 222/146.1 X |
| 2,912,142 | 11/1959 | Schultz | 222/146.1 X |
| 3,363,432 | 1/1968 | Sholtes | 62/397 |
| 3,367,133 | 2/1968 | Dreis et al. | 62/397 X |
| 3,484,011 | 12/1969 | Greenhalgh et al. | 222/183 X |
| 4,516,693 | 5/1985 | Gaston | 222/183 X |
| 4,629,096 | 12/1986 | Schroer et al. | 62/395 X |
| 4,658,989 | 4/1987 | Bonerb | 222/185 X |
| 4,805,808 | 2/1989 | Larson | 222/185 |
| 4,972,976 | 11/1990 | Romero | 222/185 |

OTHER PUBLICATIONS

Ebco Manufacturing Company, "Ebtech Just Made Bigger Better" (brochure), Oct. 1991.

Sunroc, "Illustrated Parts Listing & Service Instructions" (brochure).

*Primary Examiner*—Kevin P. Shaver

*Attorney, Agent, or Firm*—Panitch Schwarze Jacobs & Nadel

[57] ABSTRACT

A modular liquid dispensing apparatus having a housing with a reservoir for holding liquid. A readily replaceable liner is positioned within the reservoir to minimize the need for sanitizing the reservoir. The liquid dispensing apparatus is modular in that it can be field converted to dispense hot water, cold water and/or room temperature water depending on the desires of the end user.

15 Claims, 6 Drawing Sheets

FIG. 4
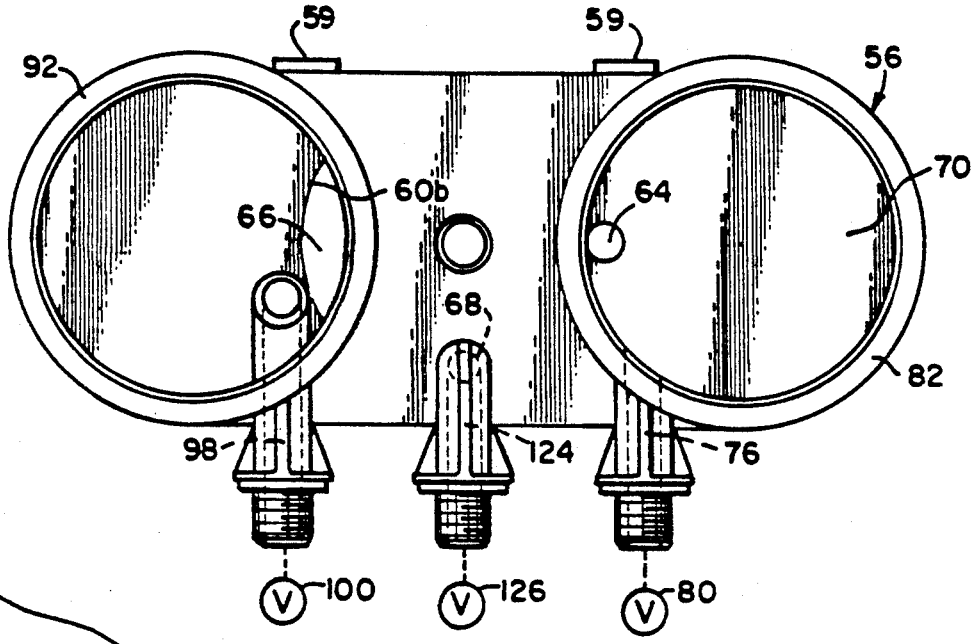
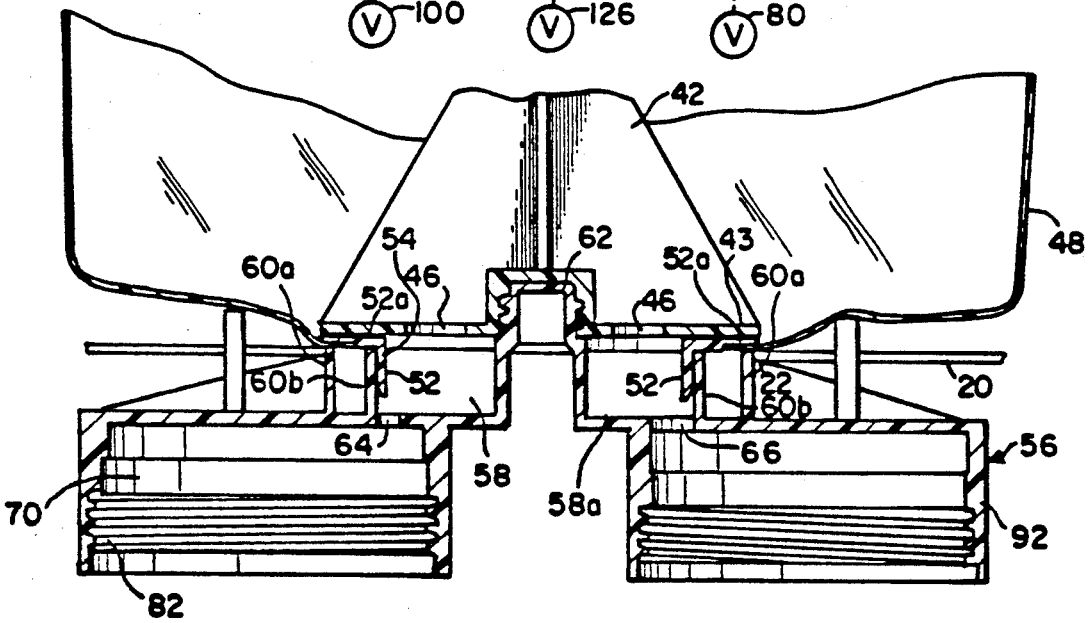
FIG. 5

LIQUID DISPENSING APPARATUS FOR DISPENSING LIQUID FROM A CONTAINER

FIELD OF THE INVENTION

The present invention relates to a liquid dispensing apparatus for dispensing liquid from a container and, more particularly, to a modular liquid dispensing apparatus which includes a disposable liner for minimizing sanitation requirements.

BACKGROUND OF THE INVENTION

Traditional devices for dispensing a liquid, such as water, from a container include a reservoir for holding a predetermined volume of the liquid in addition to the liquid within the container. The reservoir is normally constructed of a corrosion resistant metallic material, such as stainless steel. Since the reservoir is exposed to ambient air whenever the container is changed and ambient air enters the container as the liquid is displaced, it is necessary to sanitize the reservoir every six months in order to minimize dispensing bacteria in the liquid.

Sanitizing the reservoir every six months is problematic in that it results in a significant amount of downtime for the liquid dispensing device. Furthermore, the expense of having a serviceman sanitize the reservoir increases the cost of maintaining the dispensing device. Clearly, a need has arisen for a liquid dispensing device which is readily sanitized to minimize the above problems.

Conventional water or liquid dispensing devices normally have up to three dispensing valves for dispensing hot water, water at room temperature, and cold water. The number of dispensing valves provided on each water dispensing device varies in accordance with the requirements of the user. As such it is necessary to design a number of different water dispensing devices to meet each user's particular requirements. For instance, if one user preferred that the device only dispense cold water and hot water and another user preferred the device dispense cold water, hot water and room temperature water, it is necessary to manufacture two different types of water dispensing devices. Thus, a need has arisen for a single water dispensing device which can be readily converted in the field or at the assembly location to the requirements of the user.

The present invention overcomes many of the disadvantages inherent in the above-described conventional water dispensing devices by providing a disposable liner within the reservoir which can be readily replaced when the reservoir has to be sanitized. In addition, the present invention is of a modular design to allow the dispensing device to be readily converted between a two valve system wherein cold water and room temperature water is dispensed and a three valve system wherein hot water, cold water and room temperature water is dispensed. Use of the present invention results in considerable savings in money as well as time when the unit has to be sanitized and also reduces manufacturing costs by providing a single unit which can be readily converted between a two valve and a three valve system.

SUMMARY OF THE INVENTION

Briefly stated, the present invention comprises a liquid dispensing apparatus for dispensing liquid from a container having a body and a neck portion. The apparatus includes a housing having an upper wall for at least partially supporting the container. The upper wall has a periphery and includes at least one side wall extending generally downwardly from the periphery of the upper wall. A bulkhead wall extends from the side wall within the housing and has an opening extending therethrough. The upper wall has an opening extending therethrough for receiving the neck portion of the container. The bulkhead wall is spaced from the upper wall such that the upper wall, the side wall and the bulkhead wall form a reservoir for receiving and holding liquid dispensed from the container. A funnel means is positioned within the reservoir between the opening in the upper wall and the opening in the bulkhead wall for directing liquid flowing from the neck portion of the container into the reservoir and from the reservoir through the opening in the bulkhead wall. A liner is releasably positioned within the reservoir and includes a first opening releasably positioned in alignment with the opening in the upper wall. The first opening has a periphery sealingly positioned between the opening in the upper wall and the funnel means for preventing liquid from passing therebetween. The liner includes a second opening releasably positioned in alignment with the opening in the bulkhead wall. The second opening has a periphery sealingly positioned between the opening in the bulkhead wall and the funnel means. The liner is positioned in substantial engagement with the reservoir such that liquid within the reservoir is prevented from directly engaging the upper wall, the side wall and the bulkhead wall. Selective dispensing means is provided in fluid communication with the opening in the bulkhead wall for selectively dispensing liquid from the reservoir, through the second opening in the liner and through the opening in the bulkhead wall whereby the liner is replaceable with a second liner without sanitizing the reservoir.

BRIEF DESCRIPTION OF THE DRAWINGS

The foregoing summary, as well as the following detailed description of the preferred embodiment, will be better understood when read in conjunction with the appended drawings. For the purpose of illustrating the invention, there is shown in the drawings an embodiment which is presently preferred, it being understood, however, that the invention is not limited to the precise methods and instrumentalities disclosed. In the drawings:

FIG. 4 is a greatly enlarged bottom plan view of a bulkhead assembly for dispensing liquid from the dispensing apparatus of FIG. 1;

FIG. 5 is a greatly enlarged cross-sectional view of the bulkhead assembly and a liner of the liquid dispensing apparatus of FIG. 1;

DESCRIPTION OF PREFERRED EMBODIMENT

Figure 1:
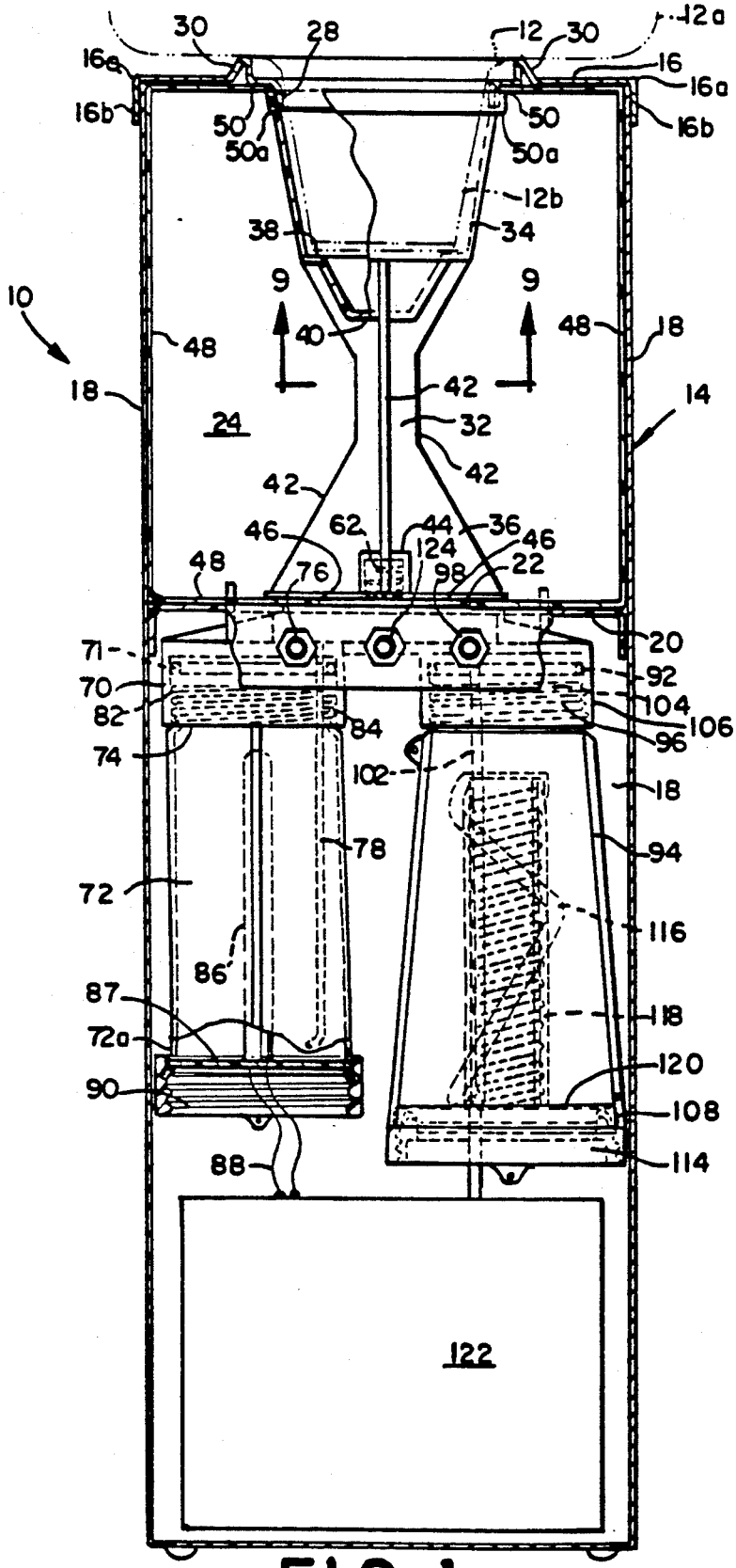
FIG. 1 is a cross-sectional view, partially broken away, of a liquid dispensing apparatus in accordance with the present invention.

Certain terminology is used in the following description for convenience only and is not limiting. The words "right," "left," "lower" and "upper" designate directions in the drawings to which reference is made. The words "inwardly" and "outwardly" refer to directions toward and away from, respectively, the geometric center of the liquid dispensing apparatus and designated parts thereof. The terminology includes the words above specifically mentioned, derivatives thereof and words of similar import.

Referring to the drawings in detail wherein like numerals indicate like elements throughout, there is shown in FIGS. 1 through 9 a liquid dispensing apparatus, generally designated 10 in accordance with the present invention. The liquid dispensing apparatus 10 is preferably designed for dispensing a liquid from a container 12 having a body 12*a* and a neck portion 12*b*. In the present embodiment, it is preferred that the liquid dispensing apparatus 10 dispense water from the container 12. However, it is understood by those skilled in the art that the present invention is not limited to dispensing any particular type of liquid. For instance, other liquids may be dispensed, such as fruit juices, punches, soft drinks, etc. without departing from the spirit and scope of the invention. For purposes of convenience only, the liquid dispensing apparatus 10 is described hereinafter as dispensing water.

The container 12 preferably holds approximately six gallons of water which is to be dispensed by the liquid dispensing apparatus 10, although it is understood by those skilled in the art that other volumes of water can be held in the container 12, such as five gallons. The body 12*a* of the container 12 may be of any design so long as it includes a neck portion 12*b*, for the reasons described hereinafter. The container 12 is only partially shown for purposes of convenience only since the shape of the body 12*a* is not pertinent to the present invention.

Referring now to FIG. 1, the liquid dispensing apparatus 10 includes a housing 14 which includes an upper wall 16 for at least partially supporting the container 12. The upper wall 16 has a periphery 16*a* which is generally square in plan view. The housing 14 includes four side walls 18 (only three are shown) extending generally downwardly from the periphery of the upper wall 16. As shown in FIG. 1, the side walls 18 extend the full length of the apparatus 10 from the upper wall 16 to the bottom of the housing 14 proximate the surface (not shown) which supports the apparatus 10. The four side walls 18 are preferably configured to correspond to the periphery of the upper wall 16 such that the apparatus 10 is generally in the form of a parallelepiped. However, it is understood by those skilled in the art that any number of side walls could be used to form the apparatus 10 in many shapes. For instance, one side wall (not shown) in the general form of a cylinder could be used. The upper wall 16 preferably includes a flange 16*b* extending downwardly from the periphery thereof around the side walls 18. The flange 16*b* permits the upper wall 16 to rest on the side walls 18 without lateral movement and yet allows the upper wall 16 to be readily lifted from the side walls 18 to provide easy access to the interior of the housing 14.

Figure 7:
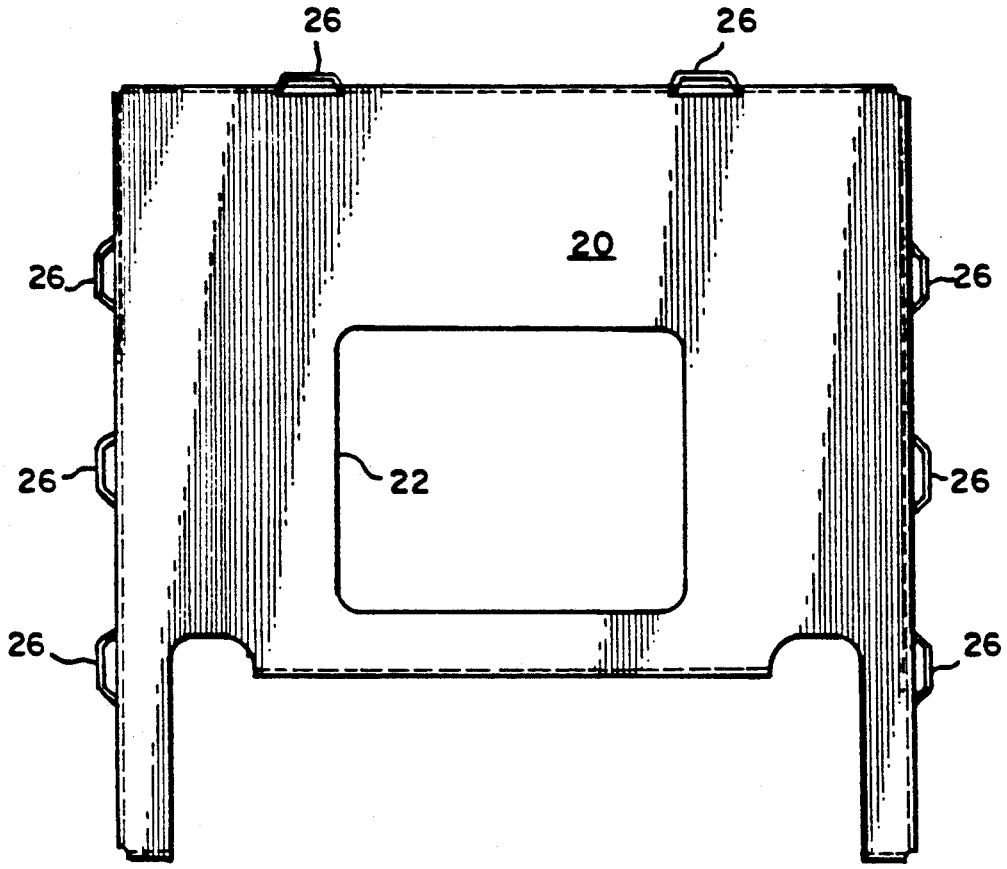
FIG. 7 is a greatly enlarged top plan view of a bulkhead wall for supporting the bulkhead assembly of FIGS. 4 and 6.
Figure 8:
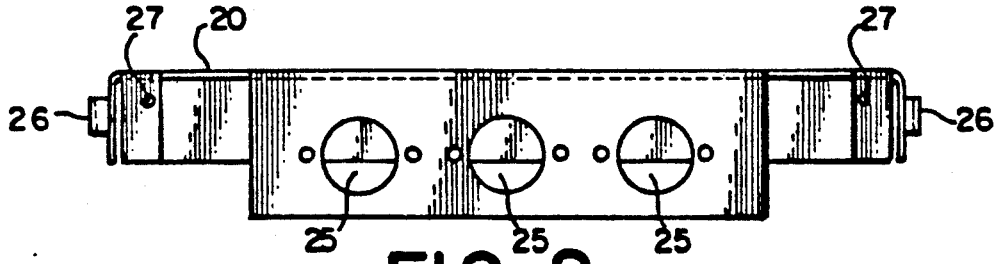
FIG. 8 is a front elevational view of the bulkhead wall shown in FIG. 7.

Referring now to FIGS. 1, 7 and 8, a bulkhead wall 20 extends from the side walls 18 within the housing 14 and has a generally rectangularly shaped opening 22 extending therethrough. The bulkhead wall 20 is spaced from the upper wall 16 such that the upper wall 16, the side walls 18 and the bulkhead wall 20 form a reservoir 24 for receiving and holding water dispensed from the container 12. As shown in FIGS. 7 and 8, the bulkhead wall 20 includes a series of channels 26 extending outwardly from the sides thereof for engaging the interior surfaces of the side walls 18 to provide support for the same. The bulkhead wall 20 is mounted to the housing 14 by a series of standard fasteners (not shown) extending through the mounting holes 27 into a frame (not shown) of the housing 14. It is understood by those skilled in the art that the present invention is not limited to mounting the bulkhead wall 20 within the housing 14 in any particular manner. For instance, the bulkhead wall 20 could be mounted to the frame by a welding process.

As shown in FIG. 1, the upper wall 16 includes a generally circular opening 28 extending therethrough for receiving the neck portion 12*b* of the container 12. Surrounding the opening 28 is a generally annular ridge 30 extending upwardly from the upper wall 16 for supporting and receiving the body 12*a* of the container 12. The opening 28 of the upper wall 16 is preferably sized to complementarily receive the neck portion 12*b* of the container 12 to transmit a portion of the weight of the container 12 to the periphery of the opening 28 for reasons described hereinafter.

The upper wall 16, side walls 18 and bulkhead wall 20 are preferably constructed of a lightweight, high strength material, such as electrogalvanized steel or blow molded high impact styrene. For instance, the upper wall 16 could be formed of high impact styrene with a leather-look finish for easy cleaning and to eliminate fingerprint marks. It is understood by those skilled in the art that the present invention is not limited to constructing the upper wall 16, side walls 18 and bulkhead wall 20 out of any particular material and that the same can be constructed of the same material or of relatively different materials.

Figure 9:
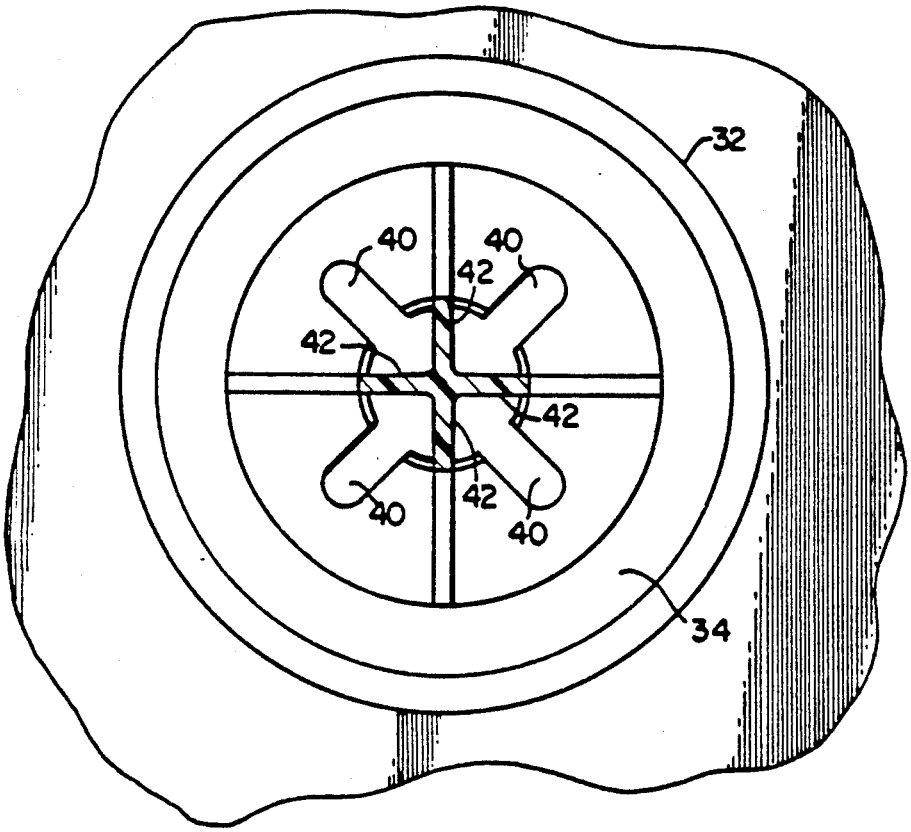
FIG. 9 is a cross-sectional view of the water dispensing device shown in FIG. 1 taken along lines 9—9 of FIG. 1.

Referring now to FIGS. 1 and 9, there is shown a funnel means positioned within the reservoir 24 between the opening 28 in the upper wall 16 and the opening 22 in the bulkhead wall 20 for directing water flowing from the neck portion 12*b* of the container 12 into the reservoir 24 and from the reservoir 24 through the opening 22 in the bulkhead wall 20. In the present embodiment, it is preferred that the funnel means be comprised of a funnel 32 having an upper portion 34 for receiving the neck portion 12*b* of the container 12 and for dispensing water from the container 12 into the reservoir 24 and a lower portion 36 for allowing water to flow from the reservoir 24 through the opening 22 in the bulkhead wall 20.

The upper portion 34 of the funnel 32 is generally frusto-conically shaped in cross section. An upper end of the upper portion 32 is aligned and engaged with the opening 28 in the upper wall 16 and a lower end has a seat 38 for receiving the tip of the neck portion 12*b* of the container 12. The seat 38, the ridge 30 and the opening 28 in the upper wall 16 all combine to at least partially support the container 12 on the housing 14, as described in more detail hereinafter. As best shown in FIG. 9, located beneath the seat 38 of the upper portion 34 is an aperture 40 for allowing water to flow from the container 12 through the aperture 40 into the reservoir 24. The aperture 40 is generally X-shaped in bottom plan view for allowing the water to be evenly dispersed within the reservoir 24.

As shown in FIGS. 1 and 5, four support legs 42 extend downwardly from the upper portion 34 towards the bulkhead wall 20. The support legs 42 extend generally radially outwardly from the longitudinal axis of the funnel 32 such that the support legs 42 are generally X-shaped in cross section (see FIG. 9). The support legs 42 extend downwardly into a base 43 which is in facing engagement with the bulkhead wall 20. The base 43 includes at least one opening 46 therethrough which is in alignment with the aperture 22 in the bulkhead wall 20 for allowing water to flow from the reservoir 24. The funnel 32 distributes almost the entire weight of the container 12 to the bulkhead wall 20 which is secured to the side walls 18 of the housing 14. As shown in FIG. 5, the lower portion 36 of the funnel 32 includes a threaded bore 44 for receiving a correspondingly threaded bolt 62 to secure the funnel 32 to the bulkhead wall 20, as described in more detail hereinafter.

In the present embodiment, it is preferred that the funnel 32 be constructed of an injection molded polypropylene for providing the funnel 32 with sufficient structural integrity to transfer the weight of the container 12 to the bulkhead wall 20. However, it is understood by those skilled in the art that the funnel 32 can be constructed of other materials such as steel, brass polycarbonate or polyvinylchloride without departing from the spirit and scope of the invention.

It is also understood by those skilled in the art that the present invention is not limited to the funnel 32 described above. That is, other means can be utilized to distribute water from the container 12 into the reservoir 24 and through the aperture 22 in the bulkhead wall 20. For instance, the lower portion 36 of the funnel 32 could be omitted if the upper wall 16 was constructed of a material having sufficient strength to support the container 12.

Referring now to FIG. 1, there is shown a liner 48 releasably positioned within the reservoir 24. The liner 48 includes a first opening 50 releasably positioned in alignment with the opening 28 in the upper wall 16. The first opening 50 has a periphery **50*a* sealingly positioned between the opening 28 of the upper wall 16 and the upper portion 34 of the funnel 32 for preventing water from passing therebetween. The weight of the water within the container 12 forces the periphery of the opening 28 in the upper wall 16 against the upper portion 34 to thereby clamp the periphery 50*a* of the first opening 50 of the liner 48** therebetween to provide a tight seal.

Referring now to FIG. 5, the liner 48 includes a second opening 52 releasably positioned in alignment with the opening 22 in the bulkhead wall 20. The second opening 52 has a periphery **52*a* sealingly positioned between the opening 22 in the bulkhead wall 20 and the lower portion 36 of the funnel 32. That is, the periphery 52*a* of the second opening 52 is sandwiched between, inter alia, the base 43 of the funnel 32 and the upper surface of the bulkhead wall 20** to thereby provide a sealed relationship.

As best shown in FIG. 1, the liner 48 is positioned in substantial engagement with the reservoir 24 such that water within the reservoir 24 is prevented from directly engaging the upper wall 16, the side walls 18 and the bulkhead wall 20. In the present embodiment, it is preferred that the liner 48 be constructed of a flexible polymeric material 48. More particularly, it is preferred that the liner 48 be thermoformed from a low density polyethylene which readily conforms to the shape of the reservoir 24.

As best shown in FIG. 5, the second opening 52 of the liner 48 includes a generally annular grommet 54 secured thereto. The grommet 54 is preferably formed as part of the liner 48 and is constructed of the same material as the liner 48. However, it is understood by those skilled in the art that the grommet 54 can be formed separately from the liner 48 and subsequently secured thereto with liquid impervious adhesive. Similarly, the grommet 54 can be constructed of a relatively different material, such as an elastomer.

Positioned beneath the bulkhead wall 20 in alignment with the opening 22 thereof, is selective dispensing means in fluid communication with the opening 22 in the bulkhead wall 20 for selectively dispensing water from the reservoir 24, through the opening 46 in the base 43, through the second opening 52 in the liner 48 and the opening 22 in the bulkhead wall 20. In the present embodiment, it is preferred that the selective dispensing means be comprised of a bulkhead assembly 56, shown in FIGS. 4 and 6. The bulkhead assembly 56 is preferably comprised of a dispensing basin 58 in fluid communication with the opening 22 in the bulkhead wall 20 for receiving water from the reservoir 24.

Figure 6:
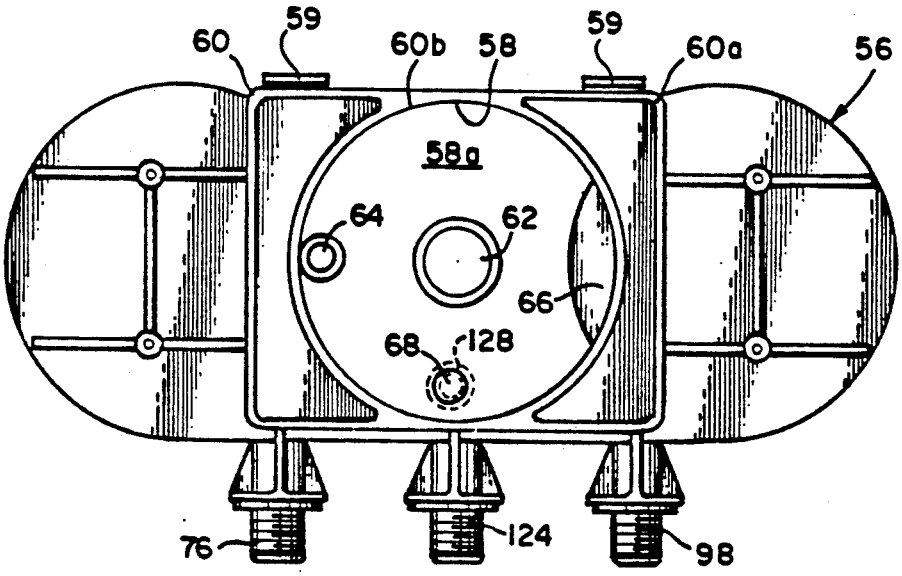
FIG. 6 is a top plan view of the bulkhead assembly of FIG. 4.

As best shown in FIG. 6, the dispensing basin 58 includes an outer periphery **60*a* which complements the opening 22 in the bulkhead wall 20 and an inner periphery 60*b* which complements the outer diameter of the grommet 54 for receiving the same. Centrally disposed within the dispensing basin 58 is a threaded bolt 62 extending upwardly through the opening 22 in the bulkhead wall 20 into the reservoir 24. The threaded bolt 62 is preferably sized to be threadably positioned within the threaded bore 44 of the funnel 32 to assist in securing the funnel 32 to the bulkhead assembly 56 and bulkhead wall 20**.

As best shown in FIG. 5, the grommet 54 is sealingly positioned between the bulkhead assembly 56 and the funnel 32 for preventing water from passing therebetween. More particularly, the exterior surface of the grommet 54 is in facing engagement with the inner periphery **60*b* of the dispensing basin 58 and the interior surface of the grommet 54 is in facing engagement with the lower surface of the base 43 of the funnel 32. The funnel 32 is releasably secured to the bulkhead assembly 56 by the threaded bore 44 and bolt 62 for facilitating removal of the grommet 54 from between the bulkhead assembly 56 and the funnel 32 when it is necessary to change the liner 48. That is, as the funnel 32 is screwed into place on the bolt 62, the grommet 54 of the liner 48 is forced into watertight contact between the base 43 of the funnel 32 and the inner periphery 60*b* of the dispensing basin 58 to thereby insure that water will not escape from the dispensing basin 58 between the bulkhead assembly 56 and the bulkhead wall 20. In addition, a secondary seal (not shown) can be positioned between the external surface of the grommet 54 and the bulkhead assembly 56** as an added safety feature.

Referring now to FIGS. 4 through 6, the dispensing basin 58 includes a first aperture 64, a second aperture 66 and a third aperture 68 for allowing water received from the reservoir 24 to flow from the dispensing basin 58 through one or more of the apertures 64, 66 and 68. The first, second and third apertures 64, 66, 68 are located in the bottom wall 58*a* of the dispensing basin 58. As shown in FIGS. 5 and 6, the dispensing basin 58 is generally cylindrically shaped for receiving the grommet 54 in a complementarily manner.

Referring now to FIGS. 1, 4 and 5, the bulkhead assembly 56 further includes a first mounting compartment 70 positioned proximate and beneath the first aperture 64 of the dispensing basin 58 such that water flows from the dispensing basin 58 to the first mounting compartment 70 through the first aperture 64. As best shown in FIG. 1, a first tank 72 having an open end 74 is complementarily positioned within the first mounting compartment 70 such that water flowing through the first aperture 64 flows into the first tank 72. The first tank 72 is preferably generally in the form of a hollow elongate cylinder open at both ends. As mentioned above, the open end 74 is positioned within the first mounting compartment 70. The distal end 72*a* is preferably sealed by a nut 90, described in more detail hereinafter. An elongate tube 78 extends from the first aperture 64 to the bottom of the first tank 72 such that water flowing from the dispensing basin 58 through the first aperture 64 flows to the bottom of the first tank 72.

Referring now to FIG. 4, the first mounting compartment 70 includes a first dispensing port 76 in fluid communication with the first tank 72. A first valve means is positioned in fluid communication with the first dispensing port 76 on the exterior of the housing 14. In the present embodiment, it is preferred that the first valve means be comprised of a first lever valve 80 (schematically shown) which is positionable between a closed or first position for preventing water from flowing through the first dispensing port 76 and an open or second position for allowing water to flow from the reservoir 24 through the opening 22 in the bulkhead wall 20, the second opening 52 of the liner 48, the first aperture 64, the elongate tube 78 into the first tank 72 and through the first dispensing port 76 due to gravity. That is, when the first lever valve 80 is placed in the open position, the gravitational force of the water positioned within the container 12 and the reservoir 24 moves the water within the dispensing basin 58 through the first aperture 64 into the bottom of the first tank 72 through the elongate tube 78. As the water enters the bottom of the first tank 72, water at the top of the first tank 72 is displaced through the first dispensing port 76.

As best shown in FIG. 1, first quick connect means is interconnected between the first mounting compartment 70 and the open end 74 of the first tank 72 for quickly connecting and disconnecting the first mounting compartment 70 and the first tank 72. In the present embodiment, it is preferred that the first quick connect means be comprised of complementary internal threads 82 within the first mounting compartment 70 and external threads 84 formed on the outer surface of the first tank 72 proximate to the open end 74 thereof. By screwing and unscrewing the first tank 72 with respect to the first mounting compartment 70, the first tank 72 can be readily attached and removed from the first mounting compartment 70. An O-ring 71 is provided between the first tank 72 and the first mounting compartment 70 for providing a tight seal.

Referring now to FIG. 1, heating means is provided within the first tank 72 for heating water therein above room temperature. In the present embodiment, the heating means is comprised of a stainless steel tubular element 86 which is in direct contact with the water within the first tank 72. The first tank 72 preferably has a capacity of approximately sixty-four ounces for allowing a large amount of hot water to be delivered. The stainless steel tubular element 86 includes a thermal fuse (not shown) to prevent excessive heat from being generated in the case of a thermostat failure. The tubular element is heated by a pair of electrical wires 88 in communication with a control system 122, described in more detail hereinafter. As best shown in FIG. 1, the tubular element 86 extends upwardly from a base plate 87 positioned proximate the bottom of the first tank 72. The base plate 87 is fixed to the first tank 72 by a nut 90 which is threadably secured to the bottom of the first tank for allowing the tubular element 86 to be readily removed from the first tank if hot water is not desired in the apparatus 10.

While in the present embodiment it is preferred that a tubular element 86 be positioned within the first tank 72 to heat the water therein, it is understood by those skilled in the art that other means could be utilized to heat water within the first tank 72. For instance, the first tank 72 could be constructed of a metallic material which could be directly heated to raise the temperature of the water therein.

Figure 3:
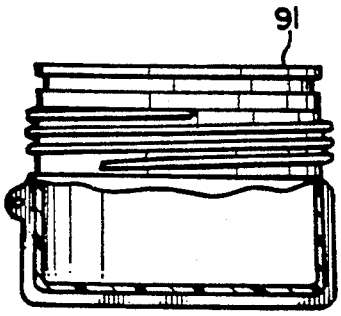
FIG. 3 is a greatly enlarged elevational view, partially in cross section, of a cap for holding liquid at room temperature for use in connection with the liquid dispensing apparatus of FIG. 1.

Referring now to FIG. 3, when it is desired that the apparatus only dispense room temperature water and cold water, the first tank 72 is omitted and replaced with a cap 91. The cap 91 is generally identical to the first tank 72, except that it is significantly smaller in volume, does not include heating means and does not include an elongate tube 78. The cap is connected to the first mounting compartment 70 in the same manner that the first tank 72 is connected to the first mounting compartment 70. Water flows to and from the cap 91 through the first aperture 64 and out the first dispensing port 76 due to gravity, as described above in connection with the first tank 72.

As shown in FIGS. 4 and 5, a second mounting compartment 92 is positioned proximate the second aperture 66 of the dispensing basin 58 for allowing water to flow therethrough into the second mounting compartment 92. A second tank 94 having an open end 96 is complementarily positioned within the second mounting compartment 92 (as best shown in FIG. 1) such that water flowing through the second aperture 66 flows into the second tank 94. The second mounting compartment 92 includes a second dispensing port 98 for dispensing water from the second tank 94. An elongate conduit 102 extends from the second dispensing port 98 within the second mounting compartment 92 to the bottom of the second tank 94 for withdrawing water from the bottom of the second tank 94.

The second dispensing port 98 includes second valve means positioned on the exterior of the housing 14 in fluid communication with the second dispensing port 98. In the present embodiment, it is preferred that the second valve means be comprised of a second lever valve 100 positionable between a closed or first position for preventing water from flowing through the second dispensing port 98 and an open or second position for allowing water to flow from the reservoir 24 through the opening 22 in the bulkhead wall 20, the second opening 52 of the liner 48, the second aperture 66 into the second tank 94, through the conduit 102 of the second dispensing port 98 and through the second dispensing port 98 due to gravity. That is, when the second lever valve 100 is placed in the open position, the gravitational force of the water positioned within the container 12 and the reservoir 24 moves the water within the dispensing basin 58 through the second aperture 66 into the top of the second tank 94. As the water enters the top of the second tank 94, water at the bottom of the second tank 94 is displaced through the conduit 102 and the second dispensing port 98.

Figure 2:
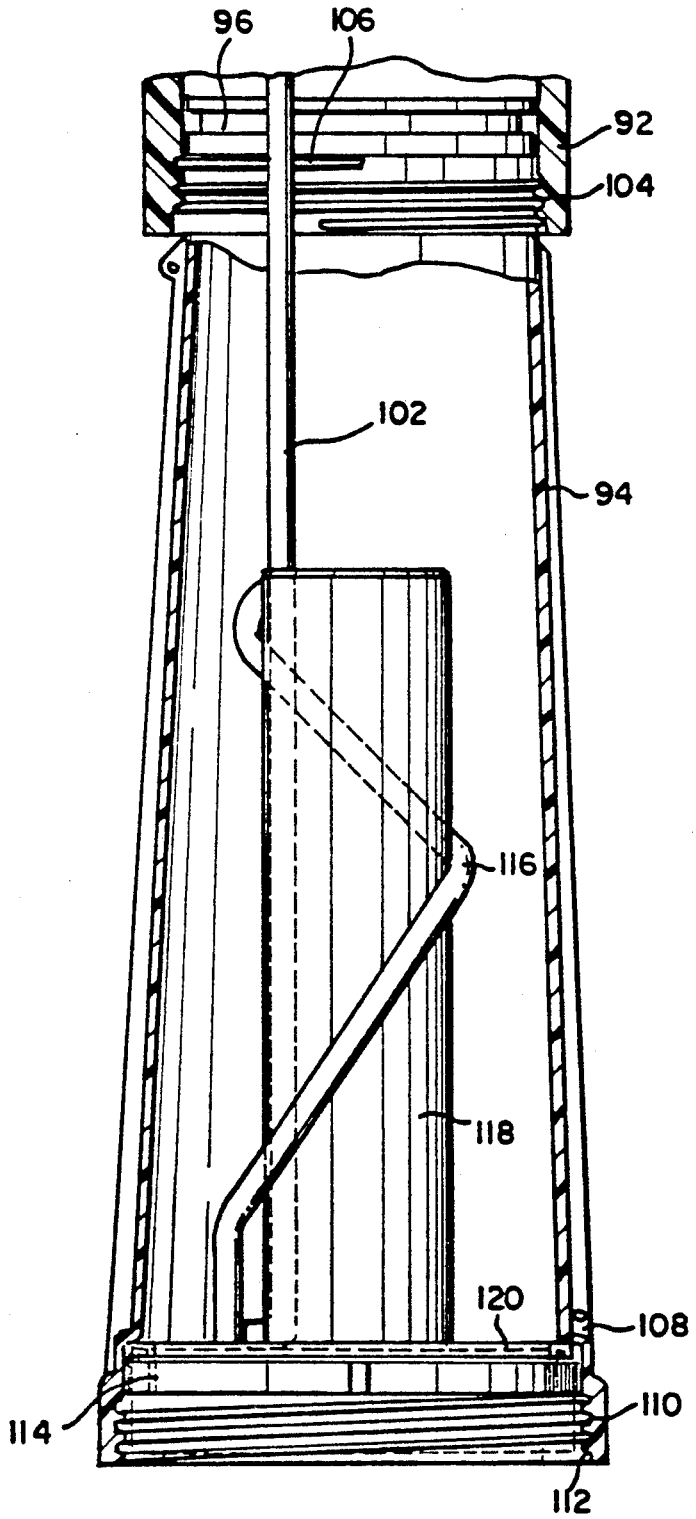
FIG. 2 is a greatly enlarged cross-sectional view of a tank for holding cold liquid for use in connection with the liquid dispensing apparatus of FIG. 1.

Referring now to FIGS. 1 and 2, second quick connect means is interconnected between the second mounting compartment 92 and the open end 96 of the second tank 94 for quickly connecting and disconnecting the second mounting compartment 92 and the second tank 94. In the present embodiment, it is preferred that the second quick connect means be comprised of cooperating internal threads 104 within the second mounting compartment 92 and external threads 106 on the exterior surface of the open end 96 of the second tank 94. It is understood by those skilled in the art that other means can be provided for quickly connecting and disconnecting the second mounting compartment 92 and the second tank 94 as well as the first mounting compartment 70 and the first tank 72 such as a snap fit, a clamp or buckling arrangement or standard fasteners (not shown) without departing from the spirit and scope of the invention.

Referring now to FIGS. 1 and 2, the second tank 94 preferably has a capacity of approximately sixty-four ounces and is preferably generally in the form of a hollow elongate cylinder open at both ends. As mentioned previously, the open end 96 of the second tank 94 is positioned within the second mounting compartment 92. The distal end 108 of the second tank 94 has internal threads 110 for threadably receiving external threads 112 of a nut 114. Cooling means is positioned within the second tank 94 for cooling water therein below room temperature. In the present embodiment, it is preferred that the cooling means be comprised of a hollow coil 116 positioned within and around a support column 118 within the second tank 94. It is preferred that the hollow coil 116 have a vapor-compression refrigerant, such as ammonia, flowing therethrough to cool the water within the second tank 94. It is understood by those skilled in the art that other vapor-compressible refrigerants could be used to cool the water, such as sulfur dioxide or FREON, without departing from the spirit and scope of the invention. The support column 118 includes a base 120 clamped between the nut 114 and the distal end 108 of the second tank 94. The support column 118 preferably extends a substantial length of the second tank 94 to insure that all of the water within the second tank 94 is cooled. The coil 116 sealingly extends through a complementary aperture in the net 114 to the control system 122 to receive the refrigerant.

Referring now to FIG. 1, positioned beneath the first and second tanks 72, 94 within the housing 14 is the control system 122. The control system 122 is comprised of the necessary hardware to control the temperature of the water within the first tank 72 and second tank 94. The temperature of the water within the first tank 72 is controlled by intermittently heating the tubular element 86 to achieve a predetermined temperature, such as 180° F., of water within the first tank 72. In the present embodiment, it is preferred that the control system 122 include a thermostat having a switch which will allow the user to easily choose between two preset temperatures, such as 120° and 180° F. Circuits for controlling the temperature of the water within the first tank 72 are well understood by those skilled in the art and, therefore, further description thereof has been omitted for purposes of convenience only and is not limiting.

Similarly, the temperature of the water within the second tank 94 is controlled by a refrigeration system (not shown) that is part of the control system 122. The refrigeration system is comprised of standard elements such as a compressor, condenser and evaporator as is well understood by those skilled in the art. Accordingly, further description of the refrigeration system is also omitted for purposes of convenience only and is not limiting.

The bulkhead assembly 56, first tank 72, nut 90, second tank 94 and nut 114 are constructed of a polymeric material which can withstand temperatures of up to 212° F. It is understood by those skilled in the art that the present invention is not limited to constructing the bulkhead assembly 56 and first and second tanks 72, 94 of any particular material. For instance, the first and second tanks 72, 94 could be constructed of a metallic material without departing from the spirit and scope of the invention.

Referring now to FIGS. 4 and 6, the bulkhead assembly 56 further includes a third dispensing port 124 in fluid communication with the third aperture 68 for allowing water to flow therethrough. The third dispensing port 124 includes third valve means positioned on the exterior of the housing 14 in fluid communication with the third dispensing port 124. In the present embodiment, it is preferred that the third valve means be comprised of a third lever valve 126 (schematically shown) positionable between a closed or first position for preventing water from flowing through the third dispensing port 124 and an open or second position for allowing water to flow from the reservoir 24 through the opening 22 in the bulkhead wall 20, the second opening 52 of the liner 48, the third aperture 68, and the third dispensing port 124 due to gravity. Consequently, water flowing through the third dispensing port 124 is at room temperature.

While in the present embodiment it is preferred that the water be dispensed through one or more of the first, second and third lever valves 80, 100, 126, it is understood by those skilled in the art that other valves could be used to control the flow of water from the dispensing ports 76, 98, 124. For instance, push button valves could be used without departing from the spirit and scope of the invention.

Referring now to FIG. 6, the bulkhead assembly 56 may include blocking means positioned within the third aperture 68 for preventing water from flowing therethrough. In the present embodiment, the blocking means is comprised of a plug 128 sealingly positioned within the second aperture 68 with a snap or friction fit. The plug 128 can be constructed of any elastomeric material to provide the requisite sealing characteristics.

To secure the bulkhead assembly 56 to the bulkhead wall 20, the bulkhead assembly 56 is positioned beneath the bulkhead wall 20 with dispensing basin 58 facing the bulkhead wall 20 and with the first, second and third dispensing ports 76, 98, 124 positioned through the corresponding support holes 25 in the side of the bulkhead wall 20, as shown in FIG. 8. The bulkhead assembly 56 is then pivoted upwardly until the flanges 59 snap over the periphery of the opening 22 of the bulkhead wall 20 to thereby firmly secure the bulkhead assembly 56 to the bulkhead wall 20.

To replace the liner 48 with a new liner, the reservoir 24 and container 12 must be emptied of all water therein. Once the reservoir 24 and container 12 are empty, the container 12 is lifted from the upper wall 16 and set aside. The upper wall 16 is then removed from the side walls 18 by merely lifting the upper wall 16 upwardly. The periphery 50*a* of the first opening 50 of the liner 48 is then moved away from the upper portion 34 of the funnel 32. The funnel 32 is then rotated about its longitudinal axis to remove the funnel 32 from the bolt 62 on the bulkhead assembly 56. The funnel 32 is then lifted from the reservoir 24 to access the grommet 54.

Once the funnel 32 is removed from the reservoir 24, the liner 48 and grommet 54 is readily removed from the reservoir 24 and is either discarded or sanitized at a different location for reuse. A new or sanitized liner is then placed within the reservoir 24 with the grommet 54 seated on the inner periphery 60*b* of the dispensing basin 58. The funnel 32 is then positioned within the reservoir 24 through the first opening 50 of the liner 48 until the threaded bore 44 receives the bolt 62 therein. The funnel 32 is then rotated to bring the base 43 of the lower portion 36 into intimate contact with the grommet 54 to thereby clamp the grommet 54 between the base 43 of the funnel 32 and the inner periphery 60*b* of the dispensing basin 58.

The periphery 50*a* of the first opening 50 is then positioned around the upper edge of the upper portion 34 of the funnel 32 and the upper wall 16 is placed in engagement with the side walls 18 such that the periphery 50*a* of the first opening 50 is clamped between the opening 28 of the upper wall 16 and the upper portion 34 of the funnel 32. The container 12 filled with water is then repositioned within the upper portion 34 of the funnel 32 to further pinch the periphery 50*a* of the first opening 50 between the upper wall 16 and the upper portion 34 of the funnel 32. Accordingly, the liner 48 of the present invention is readily replaceable with a new or sanitized liner thereby resulting in a significant savings in the amount of downtime and service time, as compared to sanitizing conventional liquid dispensing devices.

As mentioned previously, one of the advantages of the present invention is that the modularity of the liquid dispensing apparatus 10 permits the apparatus 10 to be configured in a number of different manners. For instance, to allow the liquid dispensing apparatus 10 to dispense water at three different temperatures, the bulkhead assembly 56 is installed with the first tank 72 having the tubular element 86 therein for heating the water contained in the first tank 72. In addition, the plug 128 is not positioned within the third aperture 68 and the second tank 94 includes the coil 116 for cooling the water therein. To dispense hot water from the liquid dispensing apparatus 10, the first lever valve 80 is placed in the open position which results in water flowing from the container 12 into the reservoir 24 through the apertures 40 in the funnel 32. The water within the reservoir 24 then flows through the opening 46 in the base 43 of the funnel 32, through the opening 22 in the bulkhead wall 20 into the dispensing basin 58.

Due to the gravitational force of the water within the reservoir 24 and the container 12, the water then flows through the first aperture 64, through the tube 78, to the bottom of the first tank 72. As water enters the bottom of the first tank 72, water at the top of the first tank 72 is displaced through the first dispensing port 76. The advantage of dispensing the new water to the bottom of the first tank 72 is the well recognized principle that the hottest water will rise to the top of the first tank 72 where it is displaced through the first dispensing port 76 and first lever valve 80 until the first lever valve 80 is placed in the closed position.

To dispense room temperature water from the liquid dispensing apparatus 10, the third lever valve 126 is placed in the open position to allow water to flow from the container 12 into the reservoir 24 through the apertures 40 in the funnel 32. The water in the reservoir 24 then flows through the opening 46 in the base 43 of the funnel 32, through the opening 22 in the bulkhead 20 into the dispensing basin 58. For the same reasons described above, the water within the dispensing basin 58 flows through the third aperture 68 into the third dispensing port 124 and out the third lever valve 126 until the same is placed in the closed position.

To dispense cold water from the liquid dispensing apparatus 10, the second lever valve 100 is placed in the open position to allow water to flow from the container 12 into the reservoir 24 through the apertures 40 of the funnel 32. Water within the reservoir 24 then flows through the opening 46 in the base 43 of the funnel 32, through the opening 22 of the bulkhead wall 20 into the dispensing basin 58. Water within the dispensing basin 58 then flows through the second aperture 66 into the top of the second tank 94. As water flows into the top of the second tank 94, water at the bottom of the second tank 94 is displaced through the conduit 102 to the second dispensing port 98 and through the second lever valve 100 until the same is placed in the closed position. By displacing the water at the bottom of the first tank 94, the liquid dispensing apparatus 10 takes advantage of the well-known concept that the coldest water will be positioned at the bottom of the second tank 94.

To configure the liquid dispensing apparatus 10 to dispense only hot water and cold water, the plug 128 is positioned within the third aperture 68 to prevent water from flowing therethrough. In addition, the third lever valve 126 would not be incorporated on the exterior of the housing 14 thereby allowing only hot and cold water to be dispensed from the liquid dispensing apparatus 10.

To configure the liquid dispensing apparatus 10 to dispense only room temperature and cold water, the plug 128 is positioned within the third aperture 68 and the cap 91 is used in replacement of the first tank 72. That is, the cap 91 is connected to the first compartment 70, as described above. In this manner, the liquid dispensing apparatus 10 will dispense room temperature water from the first lever valve 80 and cold water from the second lever valve 100.

While three different configurations have been described above, it is understood by those skilled in the art that the present invention can be configured in other manners to achieve different combinations of temperatures of water to be dispensed. For instance, the liquid dispensing apparatus 10 could be configured to dispense only cold water by providing plugs in the first and third apertures 64, 68, without departing from the spirit and scope of the invention.

It is apparent from the above description that the present liquid dispensing apparatus 10 can be readily converted in the field or at the manufacturing assembly site to a number of different configurations to meet the desired criteria of the end user. Accordingly, the liquid dispensing apparatus 10 of the represent invention is particularly advantageous in that it allows a single device to meet the different needs of a number of different customers.

Another advantage of the modularity of the liquid dispensing apparatus 10 is that the first tank 72, second tank 94 and cap 91 can be quickly disconnected from the bulkhead assembly 56 due to the threaded connections. Since the first tank 72, second tank 94 and cap 91 are readily removable, they can be readily sanitized in the field or replaced with a separate previously sanitized first tank, second tank or cap (not shown).

From the foregoing description, it can be seen that the present invention comprises a modular liquid dispensing apparatus having a disposable liner. It will be appreciated by those skilled in the art that changes could be made to the embodiment described above without departing from the broad inventive concept thereof. It is understood, therefore, that this invention is not limited to the particular embodiment disclosed, but it is intended to cover all modifications which are within the scope and spirit of the invention as defined by the appended claims.

We claim:

1. A liquid dispensing apparatus for dispensing liquid from a container having a body and a neck portion, said apparatus comprising:

a housing including an upper wall for at least partially supporting said container, said upper wall having a periphery, said housing including at least one side wall extending generally downwardly from the periphery of said upper wall and a bulkhead wall extending from said side wall within said housing and having an opening extending therethrough, said upper wall having an opening extending therethrough for receiving the neck portion of the container, said bulkhead wall being spaced from said upper wall such that said upper wall, said side wall and said bulkhead wall form a reservoir for receiving and holding liquid dispensed from said container;

funnel means positioned within the reservoir between said opening in said upper wall and said opening in said bulkhead wall for directing liquid flowing from said neck portion of said container into said reservoir and from said reservoir through said opening in said bulkhead wall;

a liner releasably positioned within said reservoir including a first opening releasably positioned in alignment with said opening in said upper wall, said first opening having a periphery sealingly positioned between said opening in said upper wall and said funnel means for preventing liquid from passing therebetween, said liner including a second opening releasably positioned in alignment with said opening in said bulkhead wall, said second opening having a periphery sealingly positioned between said opening in said bulkhead wall and said funnel means, said liner being positioned in substantial engagement with the reservoir such that liquid within said reservoir is prevented from directly engaging said upper wall, said side wall and said bulkhead wall; and selective dispensing means in fluid communication with said opening in said bulkhead wall for selectively dispensing liquid from said reservoir, through said second opening in said liner and through said opening in said bulkhead wall whereby said liner is replaceable with a second liner without sanitizing said reservoir.

2. The liquid dispensing apparatus as recited in claim 1 wherein said liner is constructed of a flexible polymeric material.

3. The liquid dispensing apparatus as recited in claim 1 wherein said periphery of said second opening of said liner includes a grommet secured thereto, said grommet being sealingly positioned between said dispensing means and said funnel means for preventing liquid from passing therebetween.

4. The liquid dispensing apparatus as recited in claim 3 wherein said funnel means is releasably secured to said dispensing means for facilitating removal of said grommet from between said dispensing means and said funnel.

5. The liquid dispensing apparatus as recited in claim 1 wherein said dispensing means further comprises:

a dispensing basin in fluid communication with said opening in said bulkhead wall for receiving liquid from said reservoir, said dispensing basin including a first aperture and a second aperture for allowing said received liquid to flow from said dispensing basin through one or more of said apertures;

a first mounting compartment positioned proximate said first aperture of said dispensing basin such that liquid flows from said dispensing basin to said first mounting compartment through said first aperture;

a first tank having an open end complementarily positioned within said first mounting compartment such that liquid flowing through said first aperture flows into said first tank, said first mounting compartment including a first dispensing port in fluid communication with said first tank and having first valve means positionable between a first position for preventing liquid from flowing through said first dispensing port and a second position for allowing liquid to flow from said reservoir through said opening in said bulkhead wall, said second opening of said liner, said first aperture into said first tank and through said first dispensing port due to gravity;

first quick connect means interconnected between said first mounting compartment and said open end of said first tank for quickly connecting and disconnecting said first mounting compartment and said first tank;

a second mounting compartment positioned proximate said second aperture of said dispensing basin for allowing liquid to flow therethrough into said second mounting compartment;

a second tank having an open end complementarily positioned within said second mounting compartment such that liquid flowing through said second aperture flows into said second tank, said second mounting compartment including a second dispensing port having second valve means positionable between a first position for preventing liquid from flowing through said second dispensing port and a second position for allowing liquid to flow from said reservoir through said opening in said bulkhead wall, said second opening of said liner, said second aperture into said second tank and through said second dispensing port due to gravity;

second quick connect means interconnected between said second mounting compartment and said open end of said second tank for quickly connecting and disconnecting said second mounting compartment and said second tank.

6. The liquid dispensing apparatus as recited in claim 1 further including heating means positioned within said first tank for heating liquid therein above room temperature.

7. The liquid dispensing apparatus as recited in claim 1 further including cooling means positioned within said second tank for cooling liquid therein below room temperature.

8. The liquid dispensing apparatus as recited in claim 1 wherein said dispensing basin further includes a third aperture and a third dispensing port in fluid communication with said third aperture for allowing liquid to flow therethrough, third dispensing port further includes valve means positioned between a first position for preventing liquid from flowing through said third dispensing port and a second position for allowing liquid to flow from said reservoir through said opening in said bulkhead wall, said second opening of said liner, said third aperture, and said third dispensing port due to gravity.

9. The liquid dispensing apparatus as recited in claim 1 further including blocking means positioned within said third aperture for preventing liquid from flowing therethrough.

10. A liquid dispensing apparatus for dispensing liquid from a container having a body and a neck portion, said apparatus comprising:

a housing including an upper wall for at least partially supporting said container, said upper wall having a periphery, said housing including at least one side wall extending generally downwardly from the periphery of said upper wall and a bulkhead wall extending from said side wall within said housing and having an opening extending therethrough, said upper wall having an opening extending therethrough for receiving the neck portion of the container, said bulkhead wall being spaced from said upper wall such that said upper wall, said side wall and said bulkhead wall form a reservoir for receiving and holding liquid dispensed from said container;

funnel means positioned within the reservoir between said opening in said upper wall and said opening in said bulkhead wall for directing liquid flowing from said neck portion of said container into said reservoir and from said reservoir through said opening in said bulkhead wall;

a dispensing basin in fluid communication with said opening in said bulkhead wall for receiving liquid from said reservoir, said dispensing basin including a first aperture and a second aperture for allowing said received liquid to flow from said dispensing basin through one or more of said apertures;

a first mounting compartment positioned proximate said first aperture of said dispensing basin such that liquid flows from said dispensing basin to said first mounting compartment through said first aperture;

a first tank having an open end complementarily positioned within said first mounting compartment such that liquid flowing through said first aperture flows into said first tank, said first mounting compartment including a first dispensing port in fluid communication with said first tank and having first valve means positionable between a first position for preventing liquid from flowing through said first dispensing port and a second position for allowing liquid to flow from said reservoir through said opening in said bulkhead wall, said first aperture into said first tank and through said first dispensing port due to gravity;

first quick connect means interconnected between said first mounting compartment and said open end of said first tank for quickly connecting and disconnecting said first mounting compartment and said first tank;

a second mounting compartment positioned proximate said second aperture of said dispensing basin for allowing liquid to flow therethrough into said second mounting compartment; and a second tank having an open end complementarily positioned within said second mounting compartment such that liquid flowing through said second aperture flows into said second tank, said second mounting compartment including a second dispensing port having second valve means positionable between a first position for preventing liquid from flowing through said dispensing port and a second position for allowing liquid to flow from said reservoir through said opening in said bulkhead wall, said second aperture into said second tank and through said second dispensing port due to gravity.

11. The liquid dispensing apparatus as recited in claim 10 further including second quick connect means interconnected between said second mounting compartment and said open end of said second tank for quickly connecting and disconnecting said second mounting compartment and said second tank.

12. The liquid dispensing apparatus as recited in claim 10 further including heating means positioned within said first tank for heating liquid therein above room temperature.

13. The liquid dispensing apparatus as recited in claim 10 further including cooling means positioned within said second tank for cooling liquid therein below room temperature.

14. The liquid dispensing apparatus as recited in claim 10 wherein said dispensing basin further includes a third aperture and a third dispensing port in fluid communication with said third aperture for allowing liquid to flow therethrough, said third dispensing port further includes valve means positionable between a first position for preventing liquid from flowing through said third dispensing port and a second position for allowing liquid to flow from said reservoir through said opening in said bulkhead wall, said third aperture, and said third dispensing port due to gravity.

15. The liquid dispensing apparatus as recited in claim 10 further including blocking means positioned within said third aperture for preventing liquid from flowing therethrough.

* * * * *